US006254073B1

(12) United States Patent
Noniewicz et al.

(10) Patent No.: US 6,254,073 B1
(45) Date of Patent: Jul. 3, 2001

(54) CLAMP CLIP THAT CAN BE ACTUATED WITH ONE HAND

(75) Inventors: Zbigniew Noniewicz, Kempenich; Hans-Jürgen Schüller, Königsfeld, both of (DE)

(73) Assignee: Wolfcraft GmbH, Kempenich (DE)

( * ) Notice: Subject to any disclaimer, the term of this patent is extended or adjusted under 35 U.S.C. 154(b) by 0 days.

(21) Appl. No.: 09/422,714

(22) Filed: Oct. 21, 1999

(51) Int. Cl.[7] ..... B25B 1/02
(52) U.S. Cl. ..... 269/6; 269/170
(58) Field of Search ..... 269/165–171.5, 269/147–150, 6; 81/487

(56) References Cited

U.S. PATENT DOCUMENTS

| | | | | |
|---|---|---|---|---|
| 3,606,085 | | 9/1971 | Spilman . | |
| 4,874,155 | | 10/1989 | Goul . | |
| 4,989,847 | * | 2/1991 | Chapman | 269/170 |
| 5,161,787 | * | 11/1992 | Hobday | 269/170 |
| 5,584,458 | * | 12/1996 | Rando | 269/166 |

FOREIGN PATENT DOCUMENTS

| | | |
|---|---|---|
| 87 030 379 U | 6/1987 | (DE) . |
| 39 17 473 C2 | 5/1989 | (DE) . |
| 258 024 55 592 | 10/1997 | (DE) . |

* cited by examiner

*Primary Examiner*—Robert C. Watson
(74) *Attorney, Agent, or Firm*—Schiff Hardin & Waite

(57) ABSTRACT

The invention relates to a clamping clip that can be actuated with one hand, having a drive housing comprising a hand grip and a fixed clamping jaw, with an actuating handle that can be displaced toward a rail with a second jaw by means of pivoting actuation on the hand grip, whereby the rail is blocked against back-pressure by means of a blocking element that can be released by means of thumb pressure on a release element. For better handling, it is provided that the release element forms an actuating arm that sits on a pivot axle that protrudes laterally from the housing approximately at the level of the actuating handle, the pivot axle of said arm being arranged, in relation to the direction of clamping of the rail, before the pivot axle of the handle.

20 Claims, 7 Drawing Sheets

CLAMP CLIP THAT CAN BE ACTUATED WITH ONE HAND

FIELD OF THE INVENTION

The invention relates to a clamp clip that can be actuated with one hand, having a drive housing comprising a hand grip and a fixed clamping jaw, with an actuating handle that can be displaced toward a rail with a second jaw by pivoting actuation on the hand grip, whereby the rail is blocked against back-pressure by means of a blocking element that can be released by thumb pressure on a release element.

BACKGROUND OF THE INVENTION

A clamping clip of this sort that can be actuated with one hand is known from the German utility model 87 03 379. Seen in the direction of clamping, here there is a blocking element in the form of a pivoting lever, held in a tilted position to the rail by the force of a spring, the one end of said lever being supported at the housing and the other end protruding from the housing in a plane in which the actuating handle and the hand grip lie.

From U.S. Pat. No. 4,874,155, a clamping clip that can be actuated with one hand is likewise known in which the release element, which can be actuated by means of thumb pressure, lies behind and in a plane with the actuating handle and the hand grip, seen in the direction of clamping.

From DE 39 17 473, a clamping clip that can be actuated with one hand is previously known in which a brake lever is located in front of the hand grip and actuating handle, in the direction of the hand's grasping, which lever can be drawn toward the handle using the middle or index finger.

U.S. Pat. No. 3,606,085 specifies a cartridge printing means in which the blocking element is likewise arranged before the actuating handle in the direction of the hand's grasping.

OS 197 31 579 (which does not enjoy prior publication) specifies a clamping clip that can be actuated with one hand, in which a blocking element in the form of a stopper, arranged before the hand grip and the actuating handle (seen in the direction of the hand's grasp) can be displaced by grasping a release lever that can be actuated by the index or middle finger.

There is a need for an improved clamping clip of the above-referenced species that can be actuated with one hand.

SUMMARY OF THE INVENTION

The above need is satisfied first of all and essentially by means of the solution whereby a release element forms an actuating arm that can be pivoted about a pivot axle that protrudes laterally from the housing, approximately at the level of the actuating handle. The direction of actuation of the actuating arm is opposite to the direction of actuation of the actuating handle. In addition, the position of the actuating arm is selected so that it is located at the position of the thumb of a hand that is grasping the hand grip in a natural position. In order to actuate the actuating arm, the thumb thus does not need to be brought into a position that is backwards with respect to the handle.

In addition, it is not necessary for the fingers standing in opposition to the thumb and loosely clasping the actuating handle to alter their position. It is advantageous if the pivot axle of the actuating arm is arranged before the pivot axle of the handle, in relation to the clamping direction of the rail. This then advantageously goes along with an arrangement of the blocking element, likewise before a drive element that can be displaced by the actuating handle.

In addition, it is advantageous for the pivot axle of the actuating arm to be situated opposite the rail of the pivot axle of the handle, and for the actuating arm to cross the rail. By this means, an optimal length of the actuating arm can be selected. In order to enable actuation of the one-hand clamping clip both by the left hand and by the right hand, actuating arms arranged on both of the broader sides of the housing are provided. The actuating arms can thereby be located on a common pivot axle. This pivot axle can form a second arm.

This second arm is preferably located in the housing, and acts on the blocking element. The blocking element is thereby supported with one side on a shoulder attached fixedly to the housing. The side opposite this side is preferably actuated by the second arm of the two-armed lever arrangement in order to release the back-pressure block. In addition, it is advantageous for the second arm of the lever arrangement to act on a movement transmission lever that can be pivoted about a peg arranged on the opposite side of the rail. It is then not the second arm that acts immediately on the release element, but rather a pressure flank of the movement transmission lever.

In addition, the blocking element can be fashioned as a bolt or slide that can be displaced against a restoring spring by the release element. This bolt can then be displaced along the rail by thumb pressure on the actuating arm. When the thumb pressure is discontinued, the restoring spring effects the restoring of the stopper together with the rail. In order to achieve a compact construction, it is provided that the actuating arm or, respectively, arms respectively lie in a storage trough of the broad side of the housing. The storage trough can thereby be constructed as an angle segment and can have a flat floor on which the actuating arm glides.

A further development of the invention provides that the blocking element, seen in the direction of clamping, is located before a drive element actuated by the handle, for the step-by-step entrainment of the rail. By means of a spring, the movement transmission lever can in addition be held in a position in which the actuating arm is held in its idle position and its pressure flank is held at a distance from the blocking element. By this means, a secure back-pressure blocking of the step-by-step drive is ensured.

It is also ensured that given a buildup of tensile pressure the blocking element can be displaced slightly about its seated position on the blocking shoulder on the housing. It can additionally be provided that the second arm acts as an angled extension of the movement transmission lever. This angled extension can comprise a flat attack surface for the second arm. The movement transmission lever is preferably held in its position at a distance from the blocking element by means of a tensile spring. The positioning trenches, arranged on both sides of the housing broad-side wall, can be of circular construction, whereby the pivot axle of the actuating arm lies outside the circular storage trough. A wall can be connected to the actuating arm, which arm can have a bent shape, said wall being situated in a sliding position on the floor of the trough.

The actuating handle can in addition be divided in two, as is specified in the disclosed content of DE 197 31 579.8 (hereby incorporated by reference), whereby the lever relations of the lever transmission are fashioned such that given increasing clamping force change to smaller displacement paths of the drive element.

In an embodiment, the present invention provides a clamping clip that can be actuated with one hand. The clamping clip comprises a drive housing comprising a hand grip and a fixed clamping jaw. The housing is pivotally connected to an actuating handle. The housing includes a central passageway through which a rail passes. One end of the rail is connected to a second jaw. The housing also accommodates a stopper through which the rail passes. The actuating handle is coupled to the rail whereby pivotal movement of the actuating handle results in movement of the rail in a first clamping direction. Movement of the rail in a second clamping direction is blocked by the stopper. The stopper is coupled to a release element. The release element comprises at least one arm coupled to the housing at a first pivot axle that protrudes laterally from the housing. The first pivot axle and at least a portion of the actuating handle lie in a common plane disposed perpendicular to the rail.

In an embodiment, the actuating handle is coupled to the housing by a second pivot axle. The first pivot axle is disposed between a second pivot axle and the fixed clamping jaw.

In an embodiment, the second pivot axle is disposed between the first pivot axle and the fixed clamping jaw.

In an embodiment, the first pivot axle is disposed opposite the rail from the second pivot axle.

In an embodiment, the at least one arm extends across the rail towards the actuating handle.

In an embodiment, the at least one arm comprises two arms attached to opposing ends of the first pivot axle with the housing disposed therebetween.

In an embodiment, the at least one arm comprises a two-arm lever arrangement with a first actuating arm that extends outside of the housing and a second arm disposed inside the housing. The stopper comprises two opposing ends including a first end pivotally supported by a shoulder and a second attack end. The shoulder being fixedly connected to the housing. The second arm engages the second attack end of the stopper.

In an embodiment, the second arm engages a movement transmission lever coupled to the housing opposite the rail from the first pivot axle. The movement transmission lever is disposed between the second arm and the stopper.

In an embodiment, the stopper is connected to a first spring which biases the stopper into an oblique position with respect to the rail for blocking opening movement of the rail. The bias of the first spring is overcome by application of thumb pressure to the first arm of the release element.

In an embodiment, the housing comprises an outer surface. The outer surface of the housing comprises a trough. The at least one arm of the release element being disposed in the trough.

In an embodiment, the actuating handle engages a drive element through which the rail passes. The drive element is disposed between the fixed clamping jaw and the stopper.

In an embodiment, the movement transmission lever is biased away from the stopper by a second spring.

In an embodiment, the movement transmission lever comprises a shaped extension. The second arm of the release element engages the shaped extension.

In an embodiment, the trough disposed in the exterior of the housing is circular.

In an embodiment, the housing is connected to a spring plate that frictionally engages and brakes the rail.

In an embodiment, the actuation handle is connected to a force transmission lever. The force transmission lever is pivotally connected to the housing at a point remote from the second pivot axle. The force transmission lever engages a spring that exerts a resetting biasing force from the force transmission lever and actuation handle.

Other objects and advantages of the invention will become apparent upon reading the following detailed description and appended claims, and upon reference to the accompanying drawings.

BRIEF DESCRIPTION OF THE DRAWINGS

An embodiment of the invention is explained in the following on the basis of attached drawings, wherein.

Figure 1:
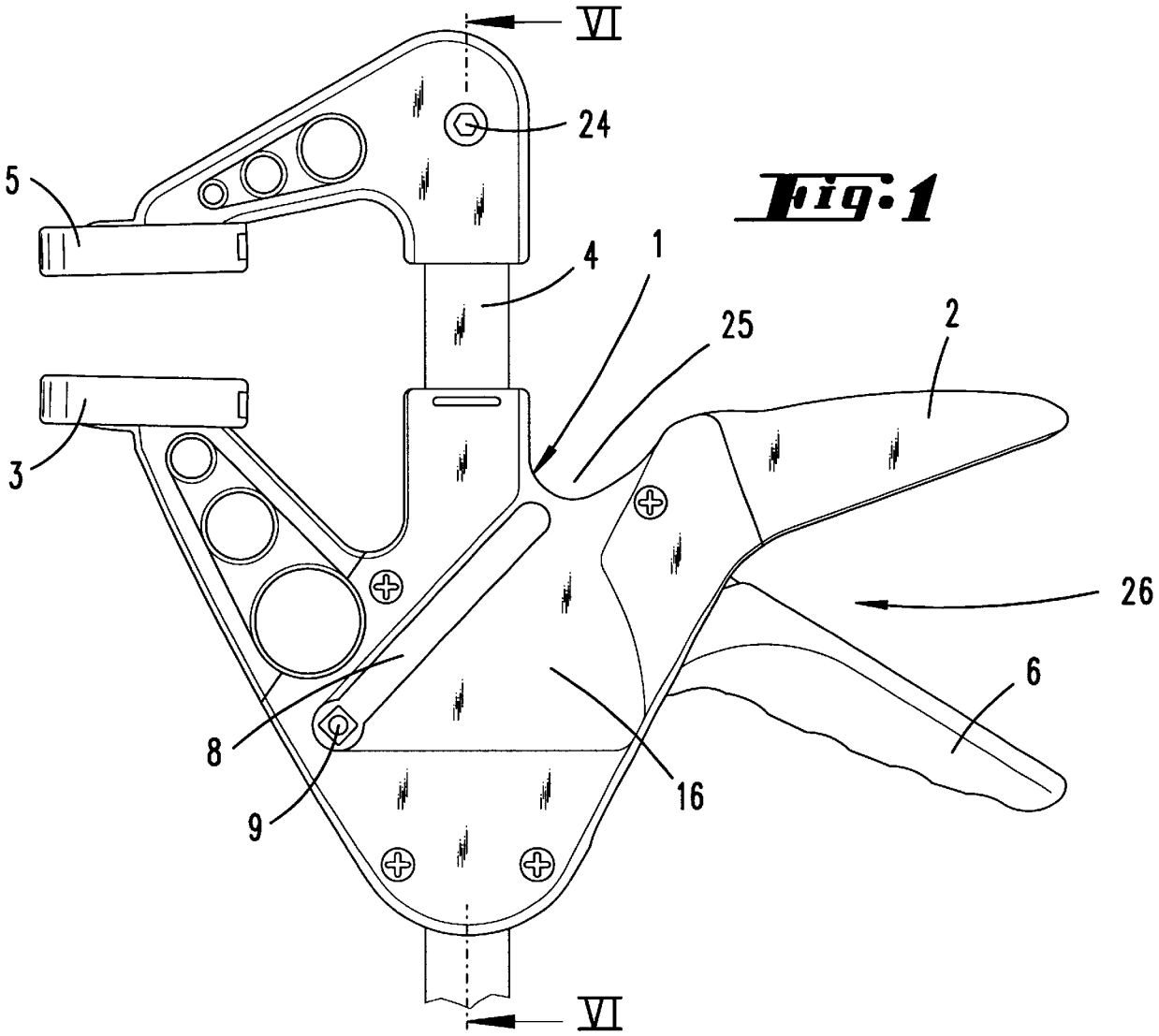
FIG. 1 is a side view of a drive housing of a clamping clip made in accordance with the present invention, with the actuating arm in the idle position.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The manner of functioning of the clamping clip shown in the embodiment is specified in DE 197 31 579.8 (which does not enjoy prior publication); for this reason, reference is hereby made thereto. From this prior application, there results in particular the interplay between the force transmission lever 21, the actuating handle 6 and the drive element 19. The force transmission lever 21 has an oblong hole penetrated by a peg 23 on the housing. According to the torque loading on the actuating handle 6, the seating point, at the housing, of the force transmission lever 21 is displaced, so that the lever relations of the lever arrangement 21, 6 acting on the drive element 19 change in such a way that the path of displacement of the drive element decreases as the torque loading increases.

Reference is also made to DE 197 31 579 in relation to the step-by-step back-displacement of the movable clamping jaw 5 away from the fixed clamping jaw 3, which back-displacement is enabled by the actuation of the release element 8.

Figure 2:
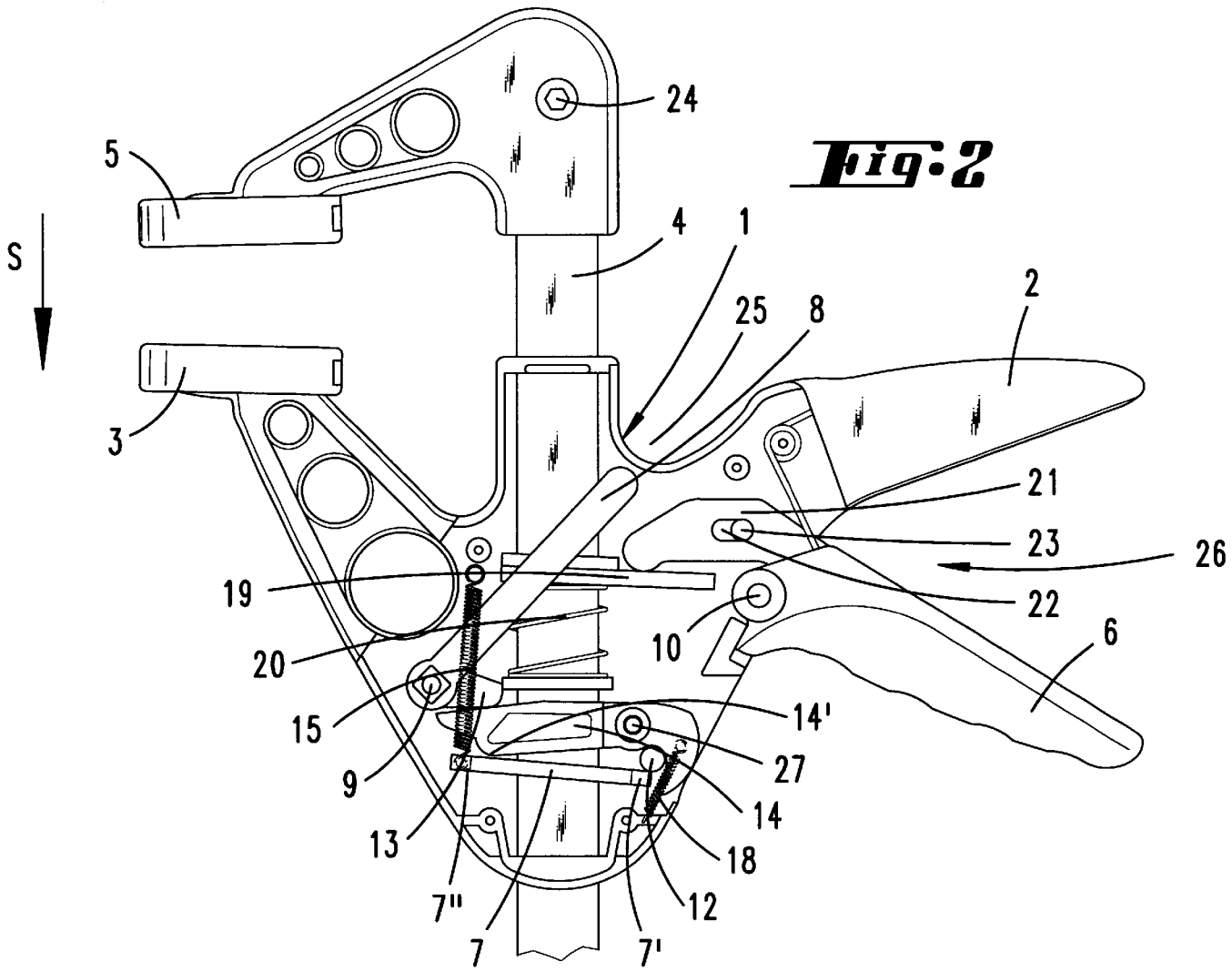
FIG. 2 is another side view of the clamping clip first shown in FIG. 1 with the housing broad-side cover removed, so that the drive apparatus is visible.

In further explanation of the above, the embodiments illustrated in FIGS. 1–8 are specified as follows:

Referring to FIGS. 1 and 2, the clamping clip has a drive housing 1 that preferably consists of two plastic shells and which forms in itself a step-by-step drive. The step-by-step drive acts on a rail 4 that penetrates the drive housing 1. The rail 4 can have a square cross-section. The rail 4, made of steel, penetrates a sharp-edged opening of a drive element 19 and a sharp-edged opening of a stopper 7 (see FIG. 2). The stopper 7 and drive element 19 are preferably made of steel. If the stopper 7 or drive element 19 are oriented transverse to the rail 4, the rail 4 can be moved freely through the opening by the stopper 7 or, respectively, the drive element 19.

Still referring to FIG. 2, in its normal position, the drive element 19 is held in the stated transverse position by a spring 20. However, by pivoting of the actuating handle 6 it is brought into a tilted position, so that when the handle 6 is actuated, the displaced drive element 19 entrains the rail 4 in the direction of clamping S. If the actuating handle 6 is released, it springs back into its idle position (see FIG. 2). The spring 20 presses the drive element 19 back into a transverse position.

The stopper 7, arranged before the drive element 19 (seen in the direction of hand attack) is supported with its end 7' against a support shoulder 12 on the housing. On the end 7" opposite the end 7', there engages a tension spring 15 attached at its end to the housing, which spring normally holds the stopper 7 in a tilted position relative to the rail 4, so that the rail 4 cannot be displaced in the direction opposed to the direction of clamping S.

A second arm 13 of a thumb-actuated release element and actuating arm 8 acts on the side 7" of the stopper 7. The second arm 13, fashioned as a pivot cam, thereby acts on the one end of a movement transmission lever mounted pivotably about an axle 27 attached fixedly to the housing.

The pivot axle 27 of the movement transmission lever 14 is located on the side of the rail opposite the attack end 7" of the stopper 7. When pivoted, the movement transmission lever 14 acts on this attack end 7" with a pressure flank 14'. In its unpivoted position, the movement transmission lever 14 is held in a position at a distance to the stopper 7 by a tension spring 18. The second arm 13 acts on a side of the movement transmission lever 14 that is immediately opposite the pressure flank 14'.

The pivot axle 9 of the two-armed lever or release element 8, 13 penetrates the two opposed broad sides 11 of the housing (see FIGS. 1 and 5), so that the actuating arm 8 can preferably be of twofold construction, namely on each housing broad side 11. During pivoting, the actuating arm 8 located on the outside of the housing glides on the floor of a storage trough or recess 16 of the housing broad side 11. Together with the pivot axle 10 of the actuating handle 6 and the pivot axle 27 of the movement transmission lever 14, the pivot axle 9 spans a triangle located before the pivot axle 10 of the handle 6 (seen in the direction of clamping S). In its idle position, the actuating arm 8 crosses the rail 4 in an oblique direction, whereby the free end of the actuating arm 8 points toward a trough or recess 25 that is arranged in the region of the root on the side of the hand grip 2 that faces away from the actuating handle 6.

The housing 1 bears a fixed clamping jaw 3, and opposite this jaw 3 there is arranged a movable clamping jaw 5 that is connected with the end of the rail 4 via a connection piece and a threaded joint 24. The connection piece may be fabricated from plastic, like the housing 1. The threaded joint 24 is detachable. The bearer (fashioned by the plastic connection piece) of the jaw 5 can also be fastened to the opposite end of the rail 4 by means of the threaded joint 24 in order to realize a spreading function of the clip.

Figure 3:
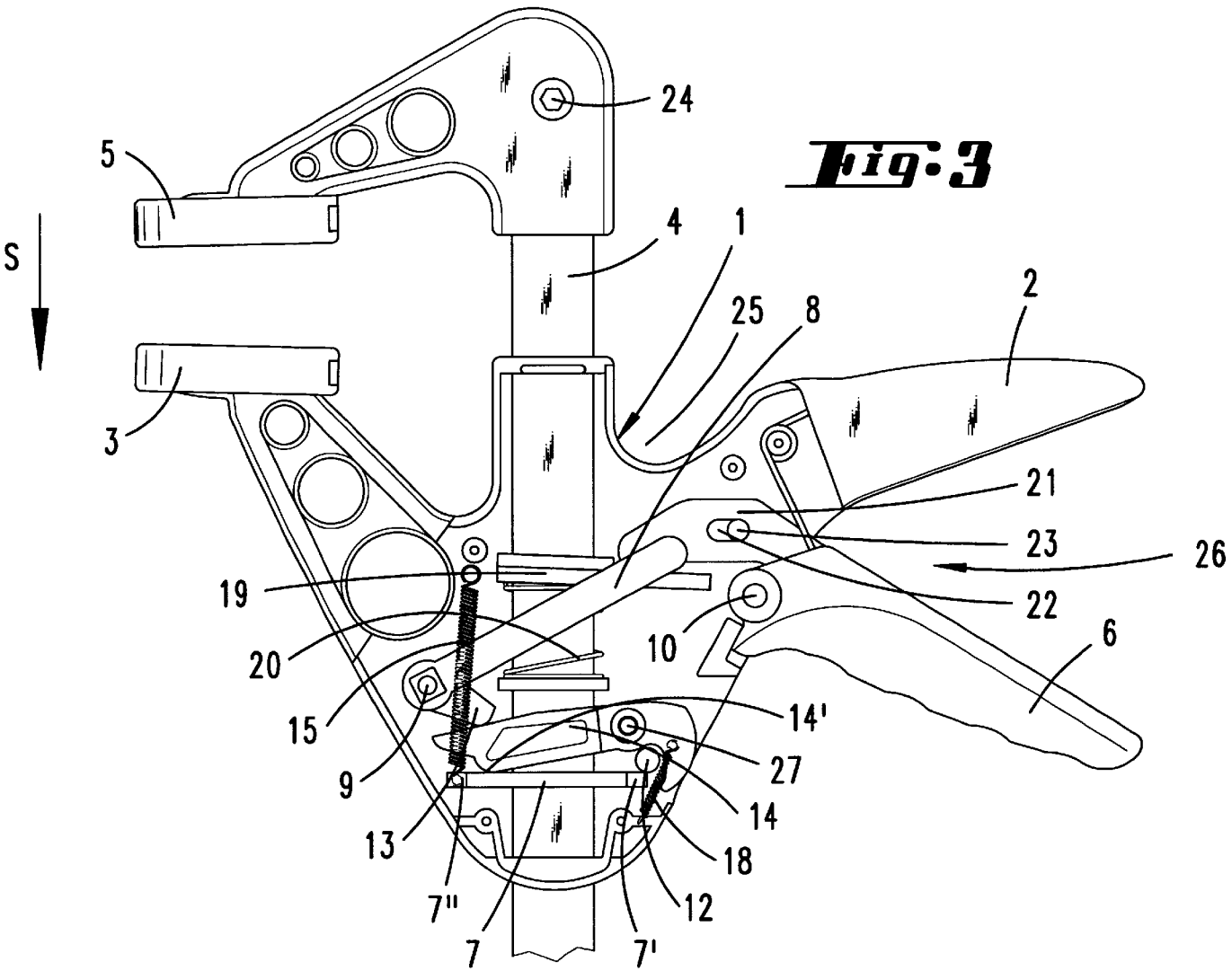
FIG. 3 is another side view according to FIG. 2, but with the stopper displaced into the release position.

In order to release the clamped position, the following action is carried out: by the action of the thumb, lying in the normal grip position on the housing broad side 11, of the hand holding the hand grip 2 and the actuating handle 6, the actuating arm 8 can be pivoted out of an idle position, shown in FIG. 2, into a first pivoted position shown in FIG. 3. In the position shown in FIG. 3, the second arm 13 has acted on the movement transmission lever 14 and pivoted it slightly about the axle 27 until the pressure flank 14' has come to be seated on the side 7" of the blocking element 7. By means of further thumb pressure, the pressure point characterized by this position is overcome, and the stopper 7 is brought out of its tilted position in such a way that the movable clamping jaw 5 can now be displaced essentially freely through the housing 1.

Subsequently, the actuating arm 8 can be displaced into a position shown in FIG. 4 by means of further thumb pressure. The actuating transmission lever 14 is thereby further pivoted by action by the second arm 13. The pressure flank 14' that engages between the side 7' and the attack point of the spring 15 on the stopper displaces the stopper 7 in the direction of clamping S, whereby the tension spring 15 is stressed. The rail 4 is thereby not entrained. Rather, the stopper 7 glides on the rail 4.

Figure 4:
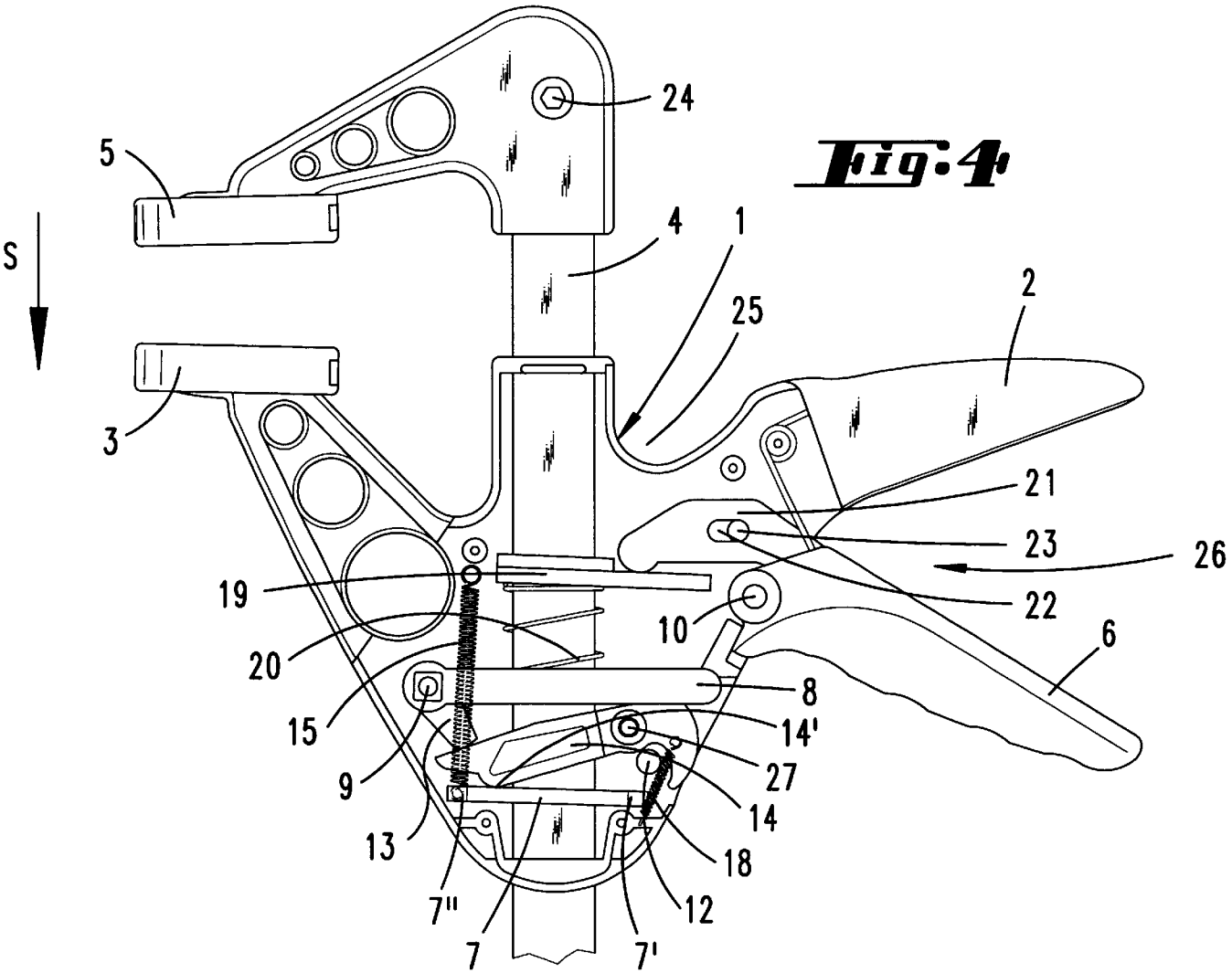
FIG. 4 is another side view according to FIG. 3, but with a stopper displaced by pivoting the actuating arm.
Figure 5:
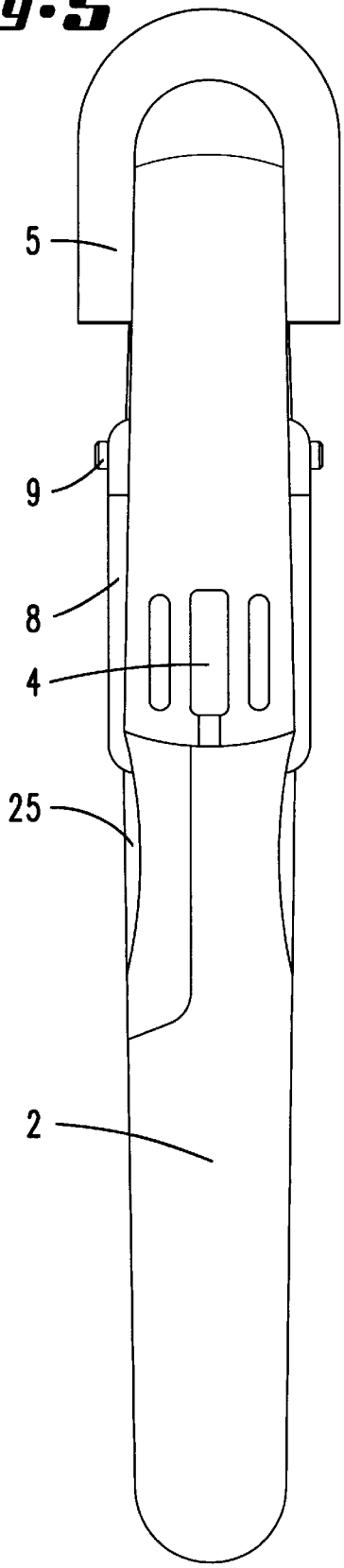
FIG. 5 is a top view of the clamping clip first shown in FIG. 1.
Figure 6:
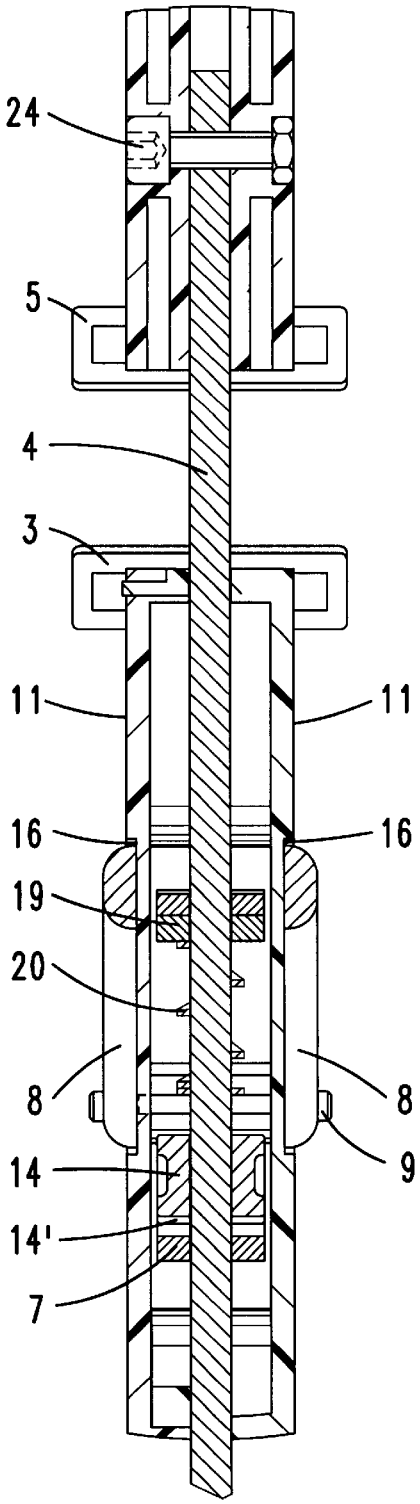
FIG. 6 is a top sectional view taken substantially along line VI—VI of FIG. 1.

If, in the position shown in FIG. 4, the actuating arm 8 is let go, the relaxing spring 18 presses the movement transmission lever 14 in the direction of its idle position. The movement transmission lever thereby acts on the second arm 13 of the release element, so that the actuating arm 8 pivots back into its position shown in FIGS. 1 and 2.

The tension spring 15 thereby likewise draws the stopper 7 back opposite to the direction of clamping S. Due to the lateral attack of the tension spring 15, the stopper 7 is thereby set into a tilted position, and entrains the rail 4 against the direction of clamping S. The movable clamping jaw 5 thereby moves away from the fixed clamping jaw 3. By means of step-by-step thumb actuation of the actuating arm 8, the movable clamping jaw 5 can thus be displaced step-by-step opposite to the direction of clamping.

Figure 7:
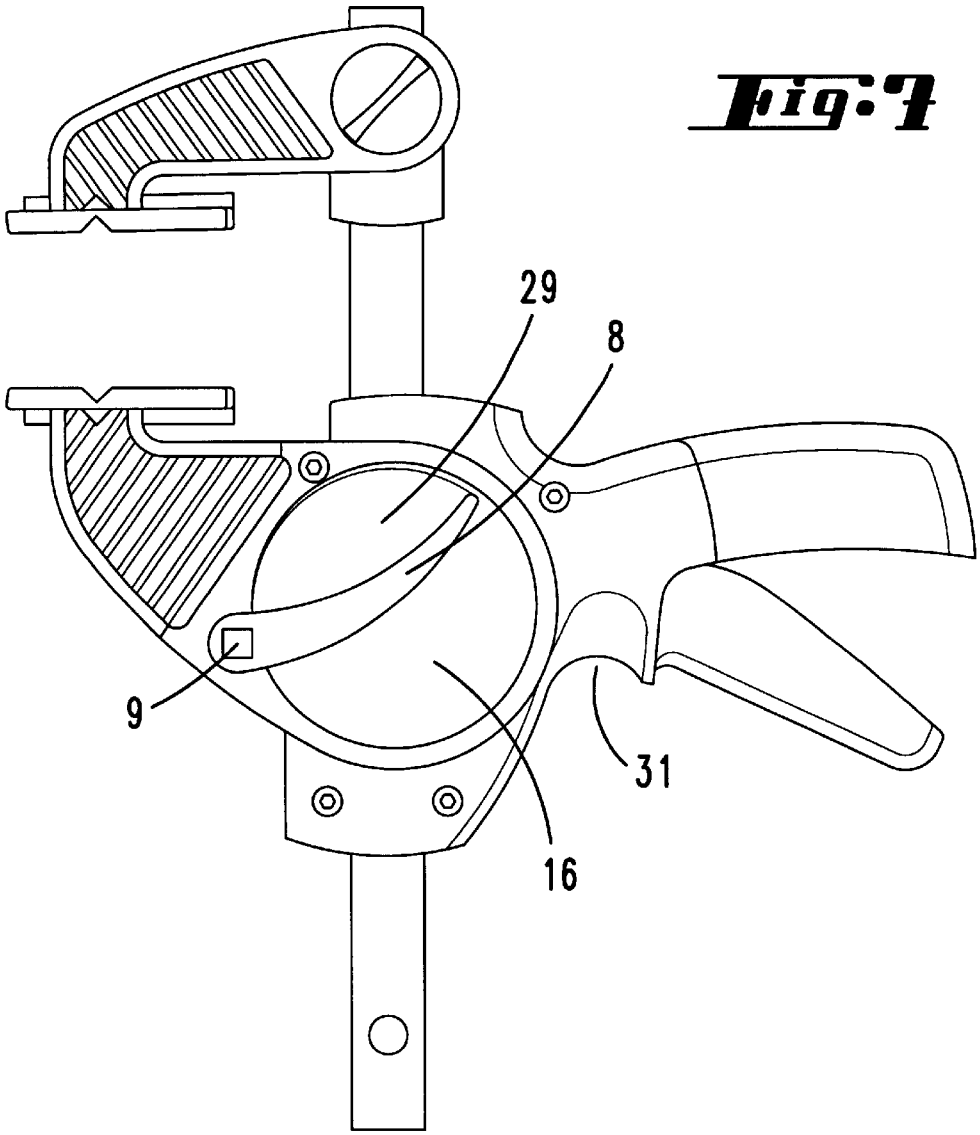
FIG. 7 is a side view of a second embodiment of a clamping clip made in accordance with the present invention.
Figure 8:
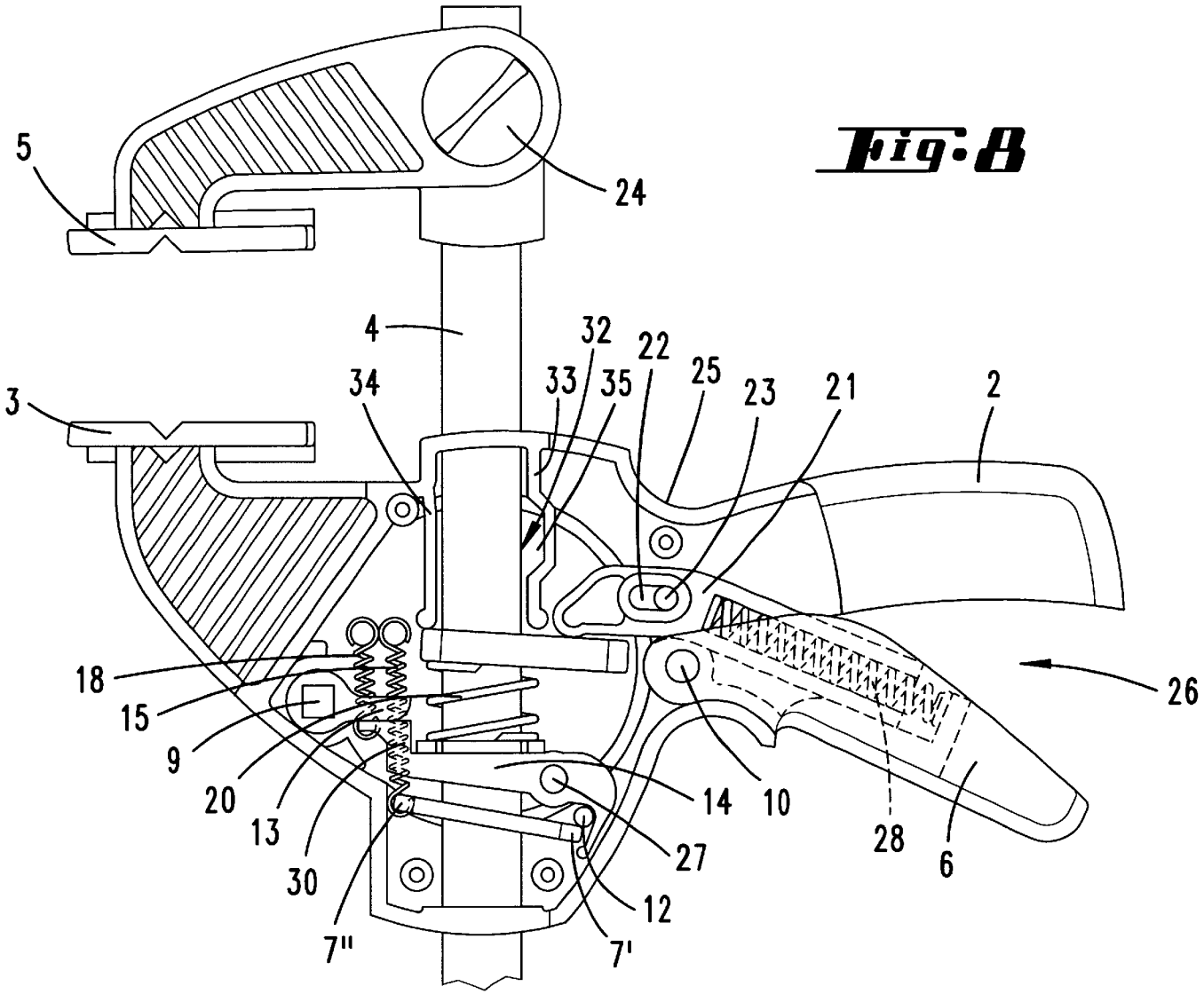
FIG. 8 is another side view of the second embodiment first shown in FIG. 7 with housing cover removed.

In the second embodiment, shown in FIGS. 7 and 8, the pivot axle 10 for the handle 6 is arranged so that the side of the actuating handle 6 that is clasped by the fingers is located closer to the back of the handle 2 than in the first embodiment. Nonetheless, however, the free wedge 26 is located between the hand grip 2 and the actuating handle 6. Opposite the trough 25, which is allocated to the back of the hand grip 2, a further trough 31 is arranged. The index finger of the hand clasping the actuating handle 6 can lie in this trough, so that the clip as a whole lies fixedly in the hand, without its being necessary for the actuating handle 6 to be clasped as such, since the trough 31 is allocated to the housing, and the actuating handle 6 first protrudes from an opening of the housing immediately adjacent to the trough 31. Since the grip 2 is of U-shaped construction, the actuating handle 6 can be pivoted even into the U-intermediate space of the hand grip 2.

The actuating handle 6, made of plastic, has an inner hollow space into which a segment of the force transmission lever 21 protrudes. The segment of the force transmission lever 21 that protrudes into the inner hollow space has a shaft that is open at one end in which there lies a pressure spring 28 that is supported against a projection of the actuating handle 6. The projection is likewise laid in the inner hollow space. The arrangement of the pressure spring 28 is selected such that it holds the actuating handle 6 in the position shown in FIG. 8. Given pivoting of the actuating handle 6 toward the grip handle, the pressure spring 28 is compressed, and thus serves, supporting the spring 20, for the resetting of the actuating handle 6.

As in the first embodiment, the blocking element 7 lies with its side 7' against a support shoulder 12 attached fixedly to the housing. The side 7" opposite the side 7' is loaded by a tensile spring in such a way that the blocking element 7 is always located, with the rail 4, in a tilted position.

The movement transmission lever 14, which can be pivoted about its axle 27, has on its free end an angled-off extension 30 that forms a flat surface against which the second arm 13 of the thumb-actuation handle acts. A tensile spring 18 also engages on this extension 30 in order to hold the movement transmission lever in a position at a distance from the stopper 7.

The pressure spring 20, which holds the drive element 19 in the transverse position, has a box-shaped cross-section. An essentially circular storage trough 16 is located on the broad side of the housing. A wall projection 29 in the shape of a circular arc, which projection is integrally formed onto the actuating arm 8 and thus gives it an L-shaped cross-section, can be displaced in sliding fashion in this storage trough.

The axle of rotation 9 of the actuating arm 8 is thereby located outside the circular storage trough 16. The actuating arm 8 is curved in the direction of its thumb-actuation side, on which side the wall projection 29 is also located.

The rail 4 is routed in the inner housing between two guide rails 33, 34. The guide rail 33 facing the actuating handle 6 has a trapezoidal opening 35. A spring plate 32 is located in this trapezoidal opening 34. The spring plate 32 is pre-stressed and exerts a frictional force on the rail 4, so that the movable jaw 5 is held in a self-locking position when it is located in the position (shown in FIG. 8) at a distance from the fixed clamping jaw 3. The frictional force exerted by the spring plate 32 on the rail 4 is sufficient to enable the displacement of the stopper 7 without entraining the rail 4.

The disclosure content of the associated/attached priority documents (copy of the prior application) is hereby also incorporated by reference, in its complete content, into the disclosure of the application, also for the purpose of incorporating by reference features of these documents into claims of the present application.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A clamping clip that can be actuated with one hand, the clamping clip comprising:

a drive housing comprising a hand grip and a fixed clamping jaw with a pair of broad sides of the housing extending therebetween, the housing being pivotally connected to an actuating handle, the housing including a central passageway through which a rail passes, one end of the rail being connected to a second jaw, the housing also accommodating a stopper through which the rail passes, the actuating handle being coupled to the rail whereby pivotal movement of the actuating handle resulting in movement of the rail in a first clamping direction, movement of the rail in a second opening direction being blocked by the stopper, the stopper being coupled to a release element, the release element comprising at least one arm being disposed along the broad side and being coupled to the housing at a first pivot axle that protrudes laterally from the broad side of the housing, the first pivot axle being positioned relative to the actuating handle so that the stopper is released by pressing on the arm by a thumb of the one hand on the grip and handle.

2. The clamping clip of claim 1 wherein the actuating handle is coupled to the housing by a second pivot axle, and the first pivot axle is disposed between the second pivot axle and the fixed clamping jaw.

3. The clamping clip of claim 1 wherein the actuating handle is coupled to the housing by a second pivot axle, and the second pivot axle is disposed between the first pivot axle and the fixed clamping jaw.

4. The clamping clip of claim 1 wherein the actuating handle is coupled to the housing by a second pivot axle, and the first pivot axle is disposed opposite the rail from the second pivot axle.

5. The clamping clip of claim 4 wherein the at least one arm extends across the rail toward the actuating handle.

6. The clamping clip of claim 1 wherein the at least one arm comprises two arms attached to opposing ends of the first pivot axle with the broad sides of the housing disposed therebetween.

7. The clamping clip of claim 1 wherein the at least one arm comprises a two-arm lever arrangement with a first actuating arm that extends outside of the housing and a second arm disposed inside the housing, and wherein the stopper comprises two opposing ends including a first end pivotally supported by a shoulder and second attack end, the shoulder being fixedly connected to the housing, the second arm engaging second attack end of the stopper.

8. The clamping clip of claim 7 wherein the second arm engages a movement transmission lever coupled to the housing opposite the rail from the first pivot axle, the movement transmission lever being disposed between the second arm and the stopper.

9. The clamping clip of claim 1 wherein the stopper is connected to a first spring which biases the stopper into an oblique position with respect to the rail for blocking opening movement of the rail, the bias of the first spring being overcome by the application of thumb pressure to the first arm of the release element.

10. The clamping clip of claim 1 wherein the actuating handle engages a drive element through which the rail passes, the drive element being disposed between the fixed clamping jaw and the stopper.

11. The clamping clip of claim 8 wherein the movement transmission lever is biased away from the stopper by a second spring.

12. The clamping clip of claim 8 wherein the movement transmission lever comprises a shaped extension, the second arm engaging the shaped extension.

13. The clamping clip of claim 1 wherein the housing in connected to a spring plate that frictionally engages and brakes the rail.

14. The clamping clip of claim 1 wherein the actuating handle is coupled to the housing by a second pivot axle, and wherein the actuating handle is connected to a force transmission lever, the force transmission lever being pivotally connected to the housing at a point remote from the second pivot axle, the force transmission lever engaging a spring that exerts a resetting biasing force on the force transmission lever and actuating handle.

15. A clamping clip that can be actuated with one hand, the clamping clip comprising:

a drive housing comprising a hand grip and a fixed clamping jaw, the housing being pivotally connected to an actuating handle, the housing including a central passageway through which a rail passes, one end of the rail being connected to a second jaw, the housing also accommodating a stopper through which the rail passes, the actuating handle being coupled to the rail whereby pivotal movement of the actuating handle results in movement of the rail in a first clamping direction, movement of the rail in a second opening direction being blocked by the stopper, the stopper being coupled to a release element, the release element comprising at least one arm coupled to the housing at a first pivot axle that protrudes laterally from the housing, the first pivot axle being spaced from the actuating handle so that the stopper is released by pressure on the one arm by a thumb of the one hand on the grip and handle, the actuating handle being coupled to the housing by a second pivot axle, and the second pivot axle being disposed between the first pivot axle and the fixed clamping jaw, and the first pivot axle being disposed opposite the rail from the second pivot axle.

16. The clamping clip of claim 15 wherein the at least one arm extends across the rail toward the actuating handle.

17. The clamping clip of claim 16 wherein the at least one arm comprises two arms attached to opposing ends of the first pivot axle with the housing disposed therebetween.

18. A clamping clip that can be actuated with one hand, the clamping clip comprising:

a drive housing comprising a hand grip and a fixed clamping jaw, the housing being pivotally connected to an actuating handle, the housing including a central passageway through which a rail passes, one end of the rail being connected to a second jaw, the housing also accommodating a stopper through which the rail passes, the actuating handle being coupled to the rail whereby pivotal movement of the actuating handle resulting in movement of the rail in a first clamping direction, movement of the rail in a second opening direction being blocked by the stopper, the stopper being coupled to a release element, the release element comprising first and second arms coupled to the housing at a first pivot axle that protrudes laterally from the housing, the first and second arms being disposed outside and on opposite sides of the housing, the actuating handle being coupled to the housing by a second pivot axle, and the second pivot axle being disposed between the first pivot axle and the fixed clamping jaw, and the first pivot axle being disposed opposite rail from the second pivot axle, the first and second arms extending across the rail and towards the actuating handle, the first pivot axle connecting first and second arms to a third arm disposed inside the housing, the stopper comprising two opposing ends including a first end pivotally supported by a shoulder and second attack end, the shoulder being fixedly connected to the housing, the third arm engaging a movement transmission lever coupled to the housing opposite the rail from the first pivot axle, the movement transmission lever being disposed between the third arm and the stopper, the movement transmission lever engaging the attack end of the stopper, the stopper being connected to a first spring which biases the stopper into an oblique position with respect to the rail for blocking opening movement of the rail, the bias of the first spring being overcome by the application of thumb pressure to the first or second arm of the release element.

19. A clamping clip according to claim 1, wherein the broad sides of the housing have a recess for receiving the at least one arm.

20. A clamping clip according to claim 19, wherein the recess is circular.

* * * * *